US006039428A

United States Patent [19]

Juve

[11] Patent Number: 6,039,428

[45] Date of Patent: Mar. 21, 2000

[54] METHOD FOR IMPROVING INK JET PRINTER RELIABILITY IN THE PRESENCE OF INK SHORTS

[75] Inventor: Ronald A Juve, Brush Prairie, Wash.

[73] Assignee: Hewlett-Packard Company, Palo Alto, Calif.

[21] Appl. No.: 09/078,394

[22] Filed: May 13, 1998

[51] Int. Cl.[7] ..... B41J 29/393

[52] U.S. Cl. ..... 347/19

[58] Field of Search ..... 347/19, 10, 76, 347/86, 5, 6, 90, 81

[56] References Cited

U.S. PATENT DOCUMENTS

| | | | |
|---|---|---|---|
| 4,683,481 | 7/1987 | Johnson | 347/65 |
| 4,812,673 | 3/1989 | Burchett | 347/10 X |
| 4,994,821 | 2/1991 | Fagerquist | 347/81 |
| 5,278,584 | 1/1994 | Keefe et al. | 347/63 |
| 5,736,997 | 4/1998 | Bolash et al. | 347/19 |
| 5,852,459 | 12/1998 | Pawlowski et al. | 347/86 |

FOREIGN PATENT DOCUMENTS

0805028A2 11/1997 European Pat. Off. .

*Primary Examiner*—Matthew S. Smith
*Assistant Examiner*—Hoan Tran

[57] ABSTRACT

A circuit and method for improving the reliability of ink jet printers in the presence of ink shorts is provided. Ground and supply voltage contacts at the electrical interconnect to the ink pens are separated by at least one electrical contact that connects a higher impedance circuit such as a data line to provide warning of the ink short in order to take corrective action before any damage to the printer occurs. Resistive isolation between each of the data lines allows the data signals to continue to reach the other pens in the presence of an ink short. After the ink short has been detected and an alarm signal generated, adaptive re-mapping of the data to utilize the remaining good pens and data lines to maximum advantage which allows the printer to continue printing. The data for the affected pen could be adaptively remapped to the remaining good pens to provide continued printing. The data can also be adaptively re-mapped to remaining good data lines to also provide for continued printing.

24 Claims, 8 Drawing Sheets

METHOD FOR IMPROVING INK JET PRINTER RELIABILITY IN THE PRESENCE OF INK SHORTS

BACKGROUND OF THE INVENTION

This invention relates generally to ink jet printing mechanisms and in particular to a circuit and method for improving the reliability of ink jet printers in the presence of ink shorts.

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chamber is located between a nozzle orifice plate and a substrate layer. This substrate layer typically contains linear arrays of heater elements, such as firing resistors, which are energized to heat ink within the vaporization chambers. Upon heating, an ink droplet is ejected from a nozzle associated with the energized resistor. By selectively energizing the firing resistors as the printhead moves across the page, the ink is expelled in a pattern on the print media to form a desired image such as a picture, chart, or text.

As the ink jet industry investigates new printhead designs, the tendency is toward using permanent or semi-permanent printheads in what is known in the industry as an "off-axis" printer. In an off-axis system, the printheads carry only a small ink supply across the print zone, with this supply being replenished through tubing that delivers ink from an "off-axis" stationary reservoir placed at a remote stationary location within the printer.

During printing, some small ink droplets may become airborne within the printer, forming what is known as "ink aerosol." Unfortunately, this ink aerosol often lands in undesirable locations on the inkjet cartridge that are not normally cleaned by the printhead service station. For example, this ink aerosol may collect along a portion of the cartridge exterior next to the electrical interconnect that sends the firing signals to the printhead. Moreover, the process of wiping the printhead often deposits ink on this portion of the cartridge adjacent to the electrical interconnect as an ink residue.

In addition to ink residue, inkjet cartridges may also suffer from ink leakage adjacent to the printhead. At the printhead, the ink supply necessarily comes in close proximity to the electrical interconnect to the die containing the firing resistors for the print head. Ink leakage from the ink supply to the adjacent electrical interconnect may penetrate to the electrical interconnect.

Beyond leaving the pen dirty with ink residue or contaminated with ink leakage, unfortunately, many inkjet inks are also electrically conductive. Any ink residue or leakage that comes in contact with the electrical interconnect has the potential for causing an electrical short circuit ("ink short") between the contacts. Ink residue deposited on the pen next to the electrical interconnect may be smeared on the contacts when the pen is removed, and then further smeared across the electrical interconnect when a new pen is installed, thus increasing the chances for a short circuit to occur.

The problem of ink shorts affecting data lines is exacerbated by the use of multiple pens that share the same data lines. Most color inkjet printers employ separate pens for black and for color. A new inkjet printer design according to the off-axis system uses four separate pens for the cyan, magenta, yellow, and black colors. Because the pens in the off-axis system are designed for a long life and thus need to be replaced only infrequently, it is possible for ink residue to build up over a long period of time. An ink short in the data line of one pen can disable the operation of remaining pens, leaving the user with the task of troubleshooting which of the four pens has the ink short. Moreover, ink shorts, particularly those between the power supply voltage and ground, can damage the printer circuitry by causing excessive current flow in the affected short circuit.

The problem of electrical short circuits in thermal ink jet printers was discussed in European Patent Application EP 0 805 028 A2 titled "Method and apparatus for detection of short circuits in thermal ink jet printers" with priority based on U.S. patent application Ser. No. 08/639385, filed Apr. 29, 1996, to Bolash et al. Bolash et al. teach energizing a data line and address line, detecting a short circuit, and inhibiting further activation of that data line. While effective for preventing damage to the printer by disabling any shorted data lines that are detected, Bolash et al. fail to address the problems of preventing damage from ink shorts between the power supply voltage and ground as well as isolating the ink short to a particular print head in thermal ink jet printers having more than one print head. Furthermore, Bolash et al. provide no teaching on adaptively re-mapping data lines or pen colors in order to improve printer reliability in the presence of ink shorts.

Therefore, it would be desirable to provide a circuit and method for improving the reliability, fault isolation, and fault tolerance of an inkjet printing mechanism in the presence of ink shorts.

SUMMARY OF THE INVENTION

In accordance with the present invention, a circuit and method for improving the reliability of ink jet printers in the presence of ink shorts is provided. In an ink jet printer having at least one print head which has an electrical interconnect for receiving data signals and clock signals over data lines, as well as a supply voltage and a ground connection, the possibility for ink shorts within the electrical interconnect reduces printer reliability and creates the possibility for damage to circuitry within the ink jet printer.

The present invention provides an electrical interconnect at the printhead in which the ground and supply voltage (+V) contacts are separated by at least one contact that connects a higher impedance circuit such as a data line. In this way, an ink short has a substantially longer distance to cover before a potentially damaging short circuit between the supply voltage and ground is made. Because the ink residue or ink generally migrates over time in a linear fashion across the electrical interconnect, a short circuit between a data line and either the ground or supply voltage connections will be made before a short circuit between the ground and supply voltage occurs, thereby providing the user with some warning of the ink short in order to take corrective action before any damage to the printer occurs.

The present invention further provides for resistive isolation between each of the data lines. Line drivers provide buffering and current sourcing/sinking capability to the print and status data, control signals, and clock signals present in each data line. The line driver has an output impedance that may be specified and selected using industry-standard, off-the-shelf parts as well as custom components. Each data line is isolated from each of the pens with an isolation resistor in each branch. The isolation resistor has a resistance selected to allow the data signals to continue to reach the other pens in the presence of an ink short between one of the data lines and either ground or the supply voltage at one of the pens. In this way, the pen having the ink short may be readily identified because it is the only pen not functioning, while the other pens may continue to function normally. At the same time, each data line is kept at a relatively high impedance according to the isolation resistance so that an ink short between a data line and the supply voltage will not generate excessive currents that could otherwise damage the printer.

After an ink short has been detected, corrective action may be taken within the printer by adaptively re-mapping pen colors or data lines to utilize the good pens and good data lines to maximum advantage to allow the printer to continue printing, albeit with reduced capability. Corrective action could be taken that would allow the printer to continue printing with the good pens that are not affected directly by the ink short. The color data for the affected pen would be adaptively remapped to the good pens to provide for continued printing but at a tradeoff in color capability. For example, if one of the cyan, magenta, or yellow (CMY) color pens develops an ink short, the printer may either manually or automatically configure itself to a monochrome mode by adaptively re-mapping the data for the CMY pen colors to the black pen. The monochrome mode may then be used until repairs to the printer can be made to correct the ink short.

Alternatively, the data flowing through the data lines can be adaptively re-mapped to the remaining good data lines using adaptive encoders and decoders. In this way, the data can still reach each of the pens but at a potential tradeoff of print speed. Using either or both of the above mentioned corrective actions for ink shorts affecting the data lines, the reliability of the ink jet printer can be improved.

One feature of the present invention is to provide a method for improving the reliability of an ink jet printer in the presence of ink shorts.

Another feature of the present invention is to provide an electrical interconnect in a printhead in which the supply voltage and ground connects are separated by at least one high impedance terminal.

A further feature of the present invention is to provide a circuit for resistively isolating data lines in an inkjet printer.

An additional feature of the present invention is a method of improving reliability in an ink jet printer by adaptively re-mapping data responsive to an ink short.

Other features, attainments, and advantages will become apparent to those skilled in the art upon a reading of the following description when taken in conjunction with the accompanying drawings.

DETAILED DESCRIPTION OF THE INVENTION

Figure 1:
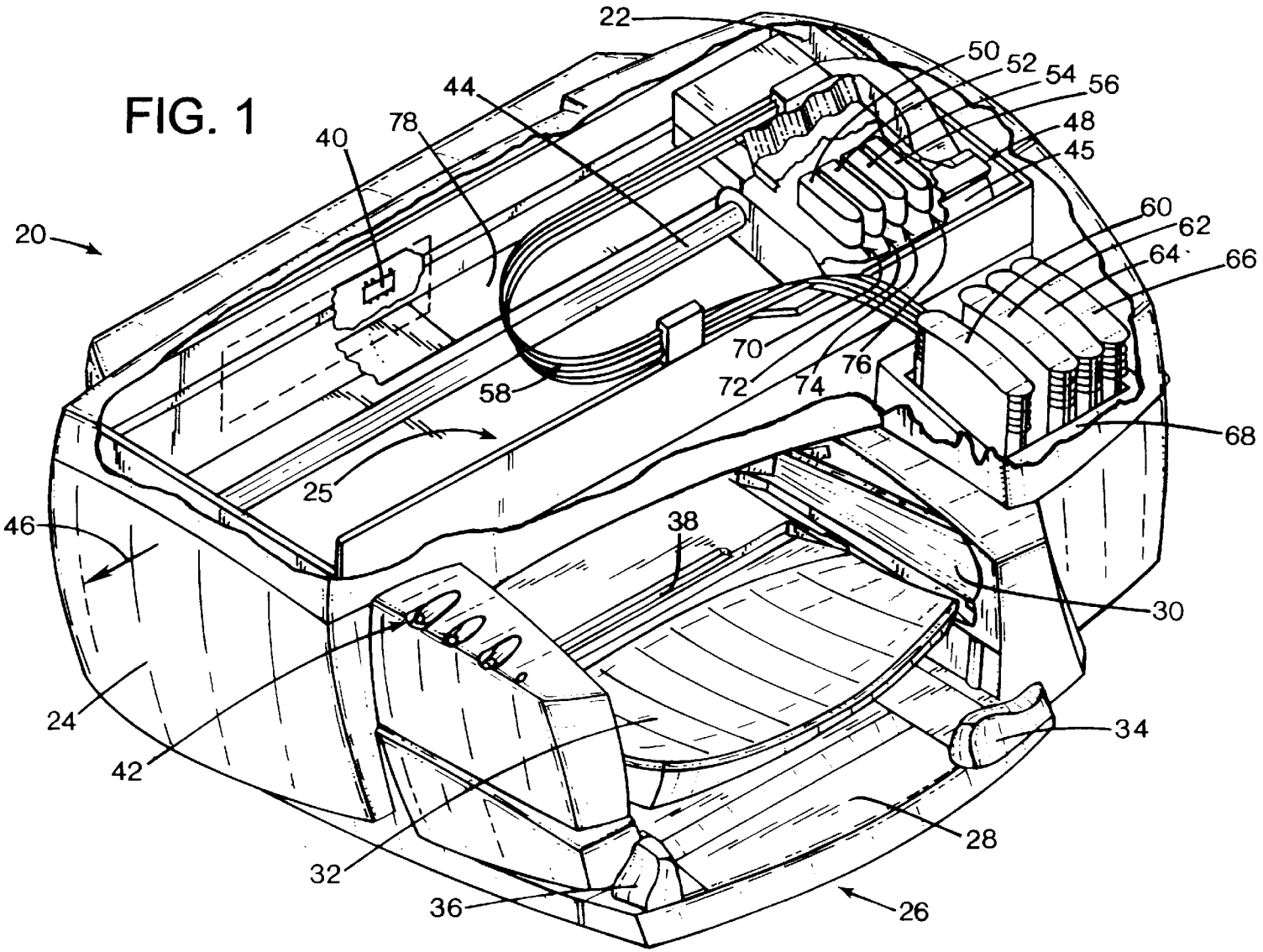
FIG. 1 is a perspective view of an inkjet printing mechanism.

FIG. 1 illustrates an embodiment of an ink jet printing mechanism, here shown as an "off-axis" inkjet printer 20, constructed in accordance with the present invention, which may be used for printing business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience, the concepts of the present invention are illustrated in the environment of an inkjet printer 20.

While it is apparent that the printer components may vary from model to model, the typical inkjet printer 20 includes a frame or chassis 22 surrounded by a housing, casing, or enclosure 24, typically of a plastic material. Sheets of printer media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. The media handling system 26 has a feed tray 28 for storing sheets of paper before printing. A series of conventional paper drive rollers driven by a stepper motor and drive gear assembly (not shown), may be used to move the print media from the feed tray 28, through the printzone 25, and after printing, on a pair of extended output drying wing members 30, shown in a retracted or rest position in FIG. 1. The wings 30 momentarily hold a newly printed sheet above any previously printed sheets still drying in an output tray 32, then the wings 30 retract to the sides to drop the newly printed sheet into the output tray 32. The media handling system 26 may include a series of adjustment mechanisms for accommodating different sizes of print media, including letter, legal, A4, and envelopes, such as a sliding length adjustment lever 34, a sliding width adjustment lever 36 and an envelope feed port 38.

The printer 20 also has a printer controller 40, illustrated schematically as a microprocessor, that receives instructions from a host device, typically a computer, such as a personal computer (not shown). The printer controller 40 may also operate in response to user inputs provided through a keypad 42 located on the exterior of the casing 24. A monitor coupled to the computer host may be used to display visual information to an operator, such as the printer status or a fault condition in a subsystem of the printer, such as an ink short. Alternatively, a user interface such as a liquid crystal display (LCD) or indicator lamps, may be included on the printer. Personal computers, their input devices, such as a keyboard and/or a mouse device, and monitors are well known to those skilled in the art.

A carriage guide rod 44 is supported by the chassis 22 to slideably support an off-axis inkjet pen carriage system 45 for travel back and forth across the printzone 25 along a scanning axis 46. The carriage 45 is also propelled along guide 44 into a servicing region, as indicated generally by arrow 48, located within the interior of the housing 24. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional optical encoder reader is mounted on the back surface of printhead carriage 45 to read positional information provide by the encoder strip. The manner of providing positional feedback information via an encoder strip reader may be accomplished in a variety of different ways known to those skilled in the art.

In the printzone 25, the media sheet receives ink from an inkjet cartridge, such as a black ink cartridge 50 and three monochrome color ink cartridges 52, 54, and 56. The cartridges 50–56 are also often called "pens" by those in the art. The black ink pen 50 is illustrated herein as containing a pigment-based ink. While the illustrated color pens 52–56 may contain pigment-based inks, for the purposed of illustration, color pens 52–56 are described as each containing a dye-based ink of the colors cyan, magenta, and yellow. It is apparent that other types of inks may also be used in pens 50–56, such as paraffin-based inks as well as hybrid or composite inks having both dye and pigment characteristics.

The illustrated pens 50–56 each include small reservoirs for storing a supply of ink in what is known as an "off-axis" ink delivery system, which is in contrast to a replaceable cartridge system where each pen has a reservoir that carries the entire ink supply as the printhead reciprocates over the printzone 25 along the scan axis 46. Hence, the replaceable cartridge system may be considered as an "on-axis" system whereas the systems that store the main ink supply at a stationary location remote from the printzone scanning axis are called "off-axis" systems. In the illustrated off-axis printer 20, ink of each color for each printhead is delivered via a conduit or tubing system 58 from a group of main stationary reservoirs 60, 62, 64, or 66 to the on-board reservoirs of pens 50, 52, 54, and 56, respectively. The stationary or main reservoirs 60–66 are replaceable ink supplies stored in a receptacle 68 supported by the printer chassis 22. Each of pens 50, 52, 54, and 56 have printheads (not shown) which selectively eject ink to form an image on a sheet of media in the printzone 25.

The concepts disclosed herein for improving the reliability of the inkjet printing mechanism apply equally to the totally replaceable inkjet cartridges, as well as to the illustrated off-axis semi-permanent or permanent pens having electrical interconnects subject to ink contamination. The greatest benefits of the illustrated system may be realized in an off-axis system where extended printhead life is particularly desirable or where a larger number of pens are used, such as the pens 50–56, each having electrical interconnects subject to ink shorts.

Figure 2:
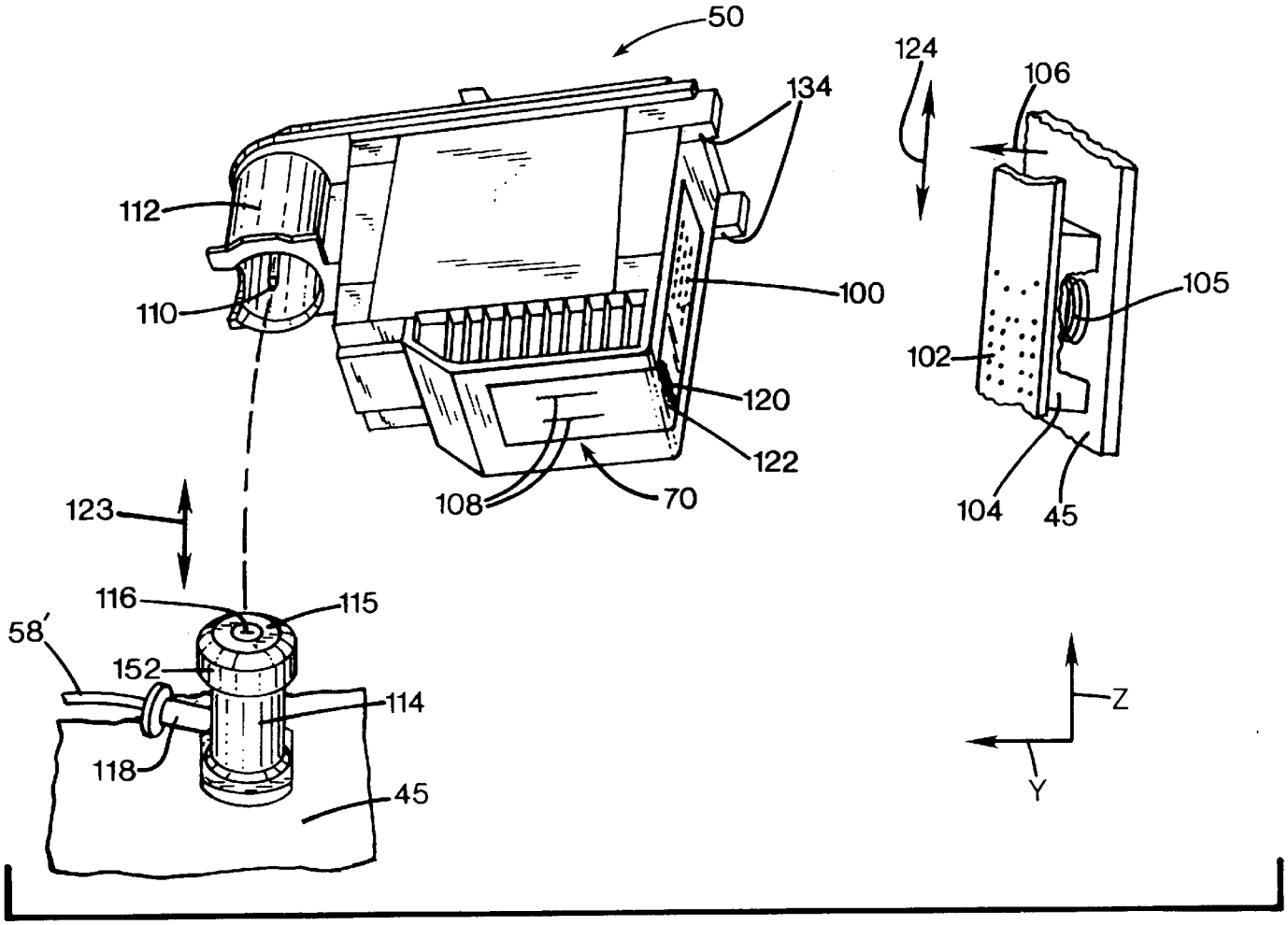
FIG. 2 is an exploded, perspective view showing various components of the printer of FIG. 1 including an inkjet cartridge and electrical interconnect.

FIG. 2 illustrates several details of the manner in which the pens 50–56 are installed within the carriage 45. For the purposes of illustration, the black pen 50 is shown, and the concepts illustrated herein are typical to pens 52, 54, and 56. The pen 50 includes an electrical interconnect 100 located along rearward and bottom facing portions of the pen 50. The electrical interconnect 100 is a flexible circuit strip containing data, power supply and ground lines which have a set of contacts on a first end located on the rearward facing portion of the pen 50 to be in electrical contact with a matching set of contacts on a flex strip 102 mounted along an interior portion of the carriage 45. To provide a solid physical contact between the contacts of the electrical interconnect 100 and the contacts of the flex strip 102, the flex strip 102 is preferably mounted above a pusher member 104, which is biased by a spring 105 to push the flex strip 102 into contact with the electrical interconnect 100, as illustrated by arrow 106.

A variety of other mechanisms have been used over the years for pushing the electrical interconnect 100 into contact with the flex strip 102, so the spring 106 is shown merely as a presently preferred embodiment for accomplishing this action, and it is apparent that a variety of other mechanisms may be substituted for the spring 105.

The electrical interconnect 100 further includes a set of contacts on the second end which mate with a corresponding set of contacts (not shown) on a printhead 70. The printhead 70 has an orifice plate with a plurality of nozzles 108 formed therethrough in a manner well known to those skilled in the art. The nozzles 108 are typically formed in at least one but typically two linear arrays along the orifice plate.

Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46, with the length of each linear array determining the maximum image swath for a single pass of the printhead 70. The printhead 70 as illustrated is a thermal inkjet printhead, although other types of printheads may be used, such as piezoelectric printheads. The printhead 70 typically includes a plurality of resistors (not shown) that are associated with the nozzles. Upon energizing a selected resistor, a bubble of gas is formed which ejects a droplet of ink from the nozzle onto a sheet of paper in the printzone 25 under the nozzle. The printhead resistors are selectively energized in response to data signals delivered through data lines in a trailing cable 150 from the printer controller 40 to the printhead carriage 45.

The electrical interconnect 100 carriers the electrical signals received from the flex strip 102 to the firing resistors within the printhead 70 which heat the ink to eject droplets form nozzles 108. In the illustrated embodiment, the nozzles 108 are arranged as two substantially linear arrays which are perpendicular to the scan axis 46 when the pen 50 is installed in carriage 45.

To allow the pen 50 to receive black ink from the main storage reservoir 60 in the illustrated off-axis printer 20, the pen 50 has a straight, hollow inlet needle 100 located along a forward portion of the pen 50. The needle 110 is guarded by a shroud 112 to prevent an operator's fingers from inadvertently coming in contact with the needle 110. The carriage 45 also supports an inlet valve 114, which has an elastomeric septum 115 defining a preformed slit 116 there through. The value 114 also has a flanged inlet port 118, to which a black ink tube 58' is coupled to receive black ink from the main reservoir 60. The black ink tube 58' is part of the tube assembly 58 in FIG. 1 that delivers ink from each of the main reservoirs 60–66 to the respective pens 50–56.

As mentioned above, during printing some of the ink droplets ejected from the nozzles 108 never reach the print media during printing but instead these droplets become floating ink aerosol satellites. This ink aerosol floats until it eventually lands, often on one of the printer components to form an ink residue 120 along the lower nose portion 122 of the electrical interconnect 100. The inlet needle 110 on the pen 50 is rigidly mounted with the shroud 112 to pierce the septum 115 along the slit 116 during pen installation. The shroud 112 is sized to surround the valve 114. While the valve 114 is preferably constructed to tilt slightly with respect to the carriage 45, it is apparent from this construction that insertion of the needle 110 into the septum 115, as well as removal therefrom, must use a substantially linear motion as indicated by arrow 123 in FIG. 2. Thus, if pen installation/removal for the inlet valve 114 at the front of the cartridge must be in a substantially vertical direction 123, then installation/removal at the rear of the cartridge where the electrical interconnect 100 is located must also be vertical, as illustrated by arrow 124.

Because the ink supplied to the printhead 70 is necessarily in close proximity to the electrical interconnect 100, it is possible that ink linkage from the ink supply may penetrate to the electrical interconnect 100 and again form ink shorts at the electrical interconnect 100. The ink leakage will typically occur between the body of the pen 50 and the electrical interconnect 100, travelling in a mostly linear direction.

Depending upon the amount of use, after several years it may be desirable to replace the pens 50–56. While it is desirable to have permanent system for pens 50–56, they may be more of a semi-permanent nature or a user may wish to switch to different types of ink, requiring the pens 50–56 to be removed from the carriage 45. Given the extended life of pens 50–56 over the earlier replaceable cartridges, these off-axis pens 50–56 reside within the printer 20 for an extended period of time, which exposes the electrical interconnect 100 to an extended period of time to accumulate the ink residue 120 as well as ink leakage.

Figure 3:
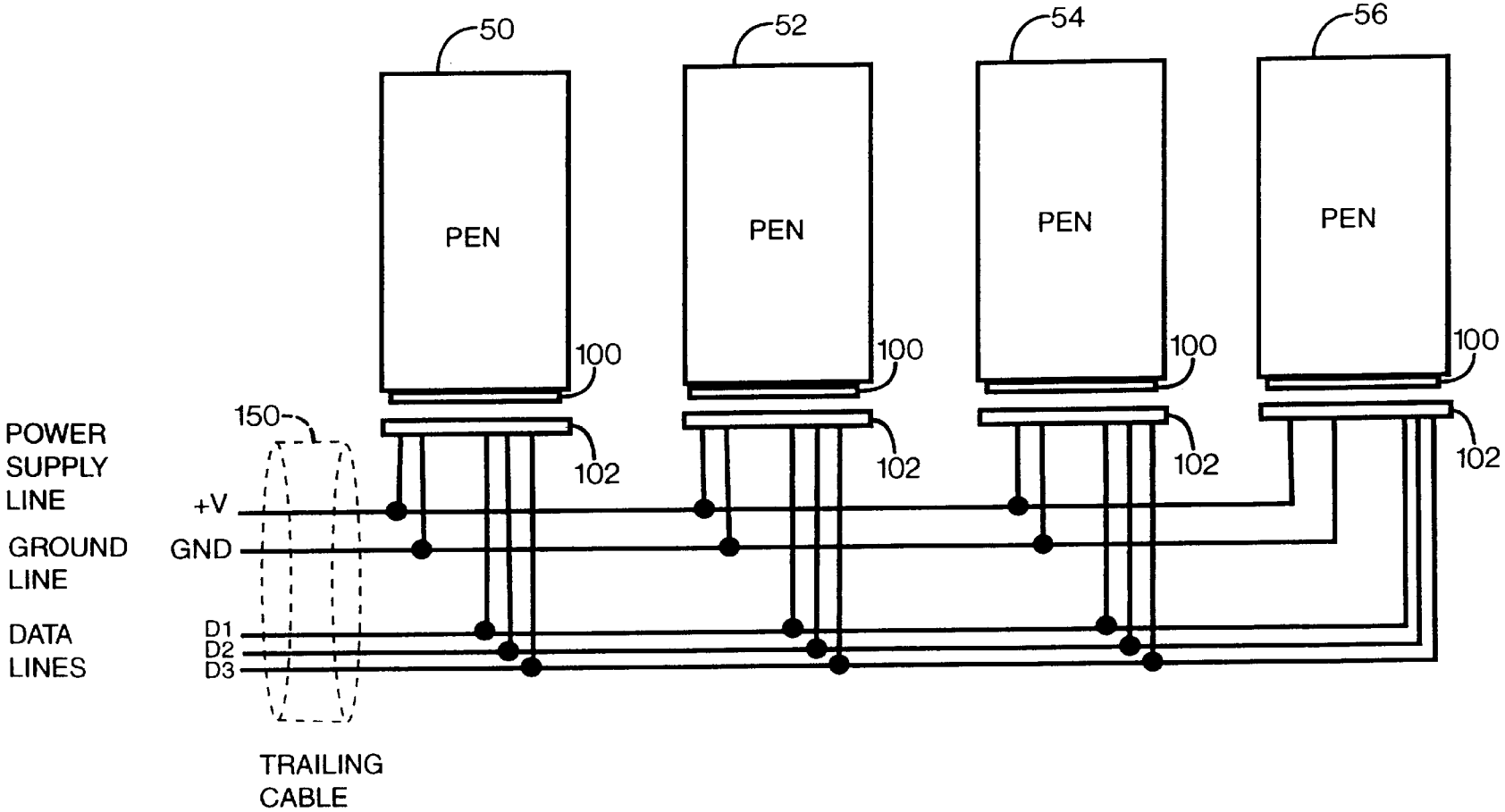
FIG. 3 is a simplified schematic diagram of a circuit for coupling data signals and supply voltages to the electrical interconnect of FIG. 2.

In FIG. 3, there is shown a simplified schematic diagram of a circuit for coupling data signals and supply voltages to the electrical interconnect 100. As the carriage 45 moves back and forth across the printzone 25 (shown in FIG. 1), the data from the printer controller 40 are routed to the pens 50–56 via the trailing cable 150 which contains data lines D1–D3 along with the supply voltage +V and ground (GND) lines to the pens 50–56. Greater or fewer numbers of data lines may be readily employed, depending on the type of printhead and the format of data being sent.

It is desirable that the trailing cable 150 have as few conductors as possible. The data lines D1–D3 are shared among the pens 50–56 using techniques well known in the art for multiplexing a common data bus. The data lines D1–D3 may be used to carry the print and status data, control signals, and clock signals. While the data lines D1–D3 shown are shared among each of the pens 50–56 in a generally parallel manner, other data lines may be uniquely connected to one of the pens 50–56, such as for pen select or pen disable signals.

The power supply line (+V), ground line (GND), and data lines D1–D3 are provided to the flex strip 102 to each of the pens 50–56 via the electrical interconnect 100. While sharing the supply voltage +V, ground, and data lines is an advantage for the minimizing the number of conductors in the trailing cable 150, the possibility of ink shorts at the electrical interconnect 100, either at the printhead 70 or the flex strip 102 among any of the pens 50–56, can result in reduced reliability of the printer 20 as explained above.

Figure 4A:
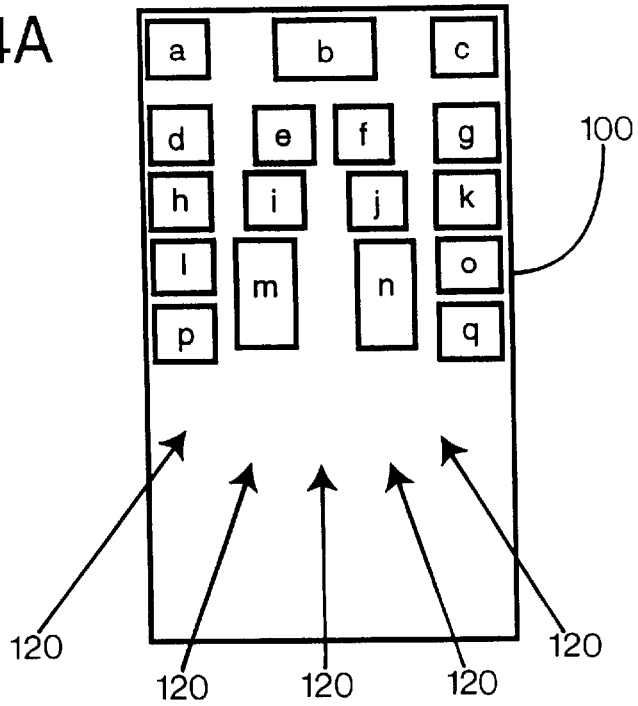
FIG. 4A and 4B are diagrams (not to scale) of the contacts at first and second ends of the electrical interconnect.
Figure 4B:
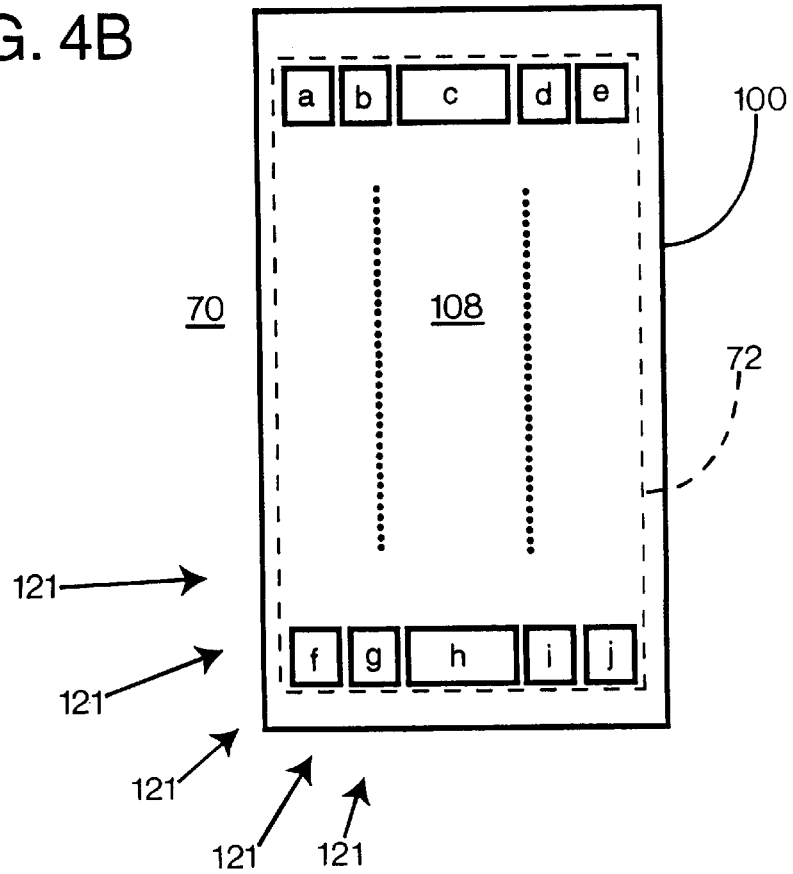

FIG. 4A and 4B are diagrams (not to scale) of contacts at first and second ends of electrical interconnect 100. In FIG. 4A, a set of contacts a–q, illustrated as shown for purposes of example, are mounted on the first end of the electrical interconnect 100 on the rearward facing portion of the pen 50 and are adapted to mate with a corresponding set of electrical contacts on the flex strip 102. The number, size, and layout of the contacts a–q may vary according the application.

The build up of the ink residue 120 may result in ink migration across the surface of the electrical interconnect 100 and flex strip 102, typically from an outside edge toward the center, as shown for example by the arrows. It was discovered that the migration of the ink residue 120 across the surface of the flex strip 102 and electrical interconnect 100 proceeds in a substantially linear manner so that the potential for ink shorts between the power supply voltage +V and the ground connection can be reduced by separating the power supply and ground contacts by at least one high impedance contact which, when shorted to +V and ground, are current limited so that no damage occurs. In the present invention, such high impedance contacts are implemented as data contacts which are resistively isolated from each other as well as from +V and ground. Increasing the physical distance between the +V and ground contacts reduces the likelihood for an ink short between the power supply and ground since the corresponding ink short would have to cover more surface area.

By interposing at least one data contact between the power supply and ground contacts, an ink short may be detected which operates as an early warning of an impending ink short between the power supply and ground as the ink short continues to spread. As the ink residue 120 migrates across the surface of the electrical interconnect 100, reaches a ground contact or a power supply contact, and then reaches a data contact to form an ink short between the ground or power supply contact and the data contact, the data contact for the affected pen becomes disabled in the manner described in further detail below, without damaging levels of current flowing through the short circuit. The user can then be alerted to the presence of an ink short. The affected pen can then be isolated and serviced to clear the ink short before further short circuit paths are created.

In the example as illustrated in FIG. 4A, contacts a–q are grouped together on the electrical interconnect 100. One approach in providing separation between +V contacts and ground contacts is to select a contact on an outside corner, for example, the contact 'a' for the power supply contact. The adjacent contacts, contacts 'd', 'e', and 'b', would then be dedicated as data contacts. The remaining contacts would then be available for either ground contacts or other data contacts. If more than one ground or power supply contacts are used on the electrical interconnect 100, data contacts would be interposed between any pair of power supply contacts and ground contacts to realize the benefits of the present invention.

In FIG. 4B, at the second end of the electrical interconnect 100, a set of contacts a–j so labeled for purposes of example are arranged to make electrical contact with a die 72 which forms a major component of the printhead 70. The die 72 is an integrated circuit containing firing resistors, nozzles, and digital logic for receiving the data from the data lines. The contacts a–j on the first and second ends may be connected together in a bus arrangement. The present invention concerns the arrangement of the contacts, either on the first or the second ends, which both suffer from ink shorts. In the second end, ink shorts are more likely the result of ink leakage 121 from the ink supplying the printhead 70. The ink leakage 121 generally occurs in the interstitial space between the electrical interconnect 100 and the surface of the pen 50 and migrates along the electrical interconnect 100 in a generally linear manner similar to that of the ink residue 120.

The selection of ground, power supply, and data contacts on the second end as shown in FIG. 4B may proceed in a manner similar to that of the first end according to the present invention. The contacts a–j are generally placed along opposing ends of a generally rectangular die 72, shown as being hidden underneath the electrical interconnect 100. Contact a is chosen to be a power supply contact. Contact b would necessarily be a data contact if contact c were chosen to be a ground contact. In a similar manner, intervening data contacts would be chosen between each power supply and ground contact for the remaining set of contacts.

Figure 5:
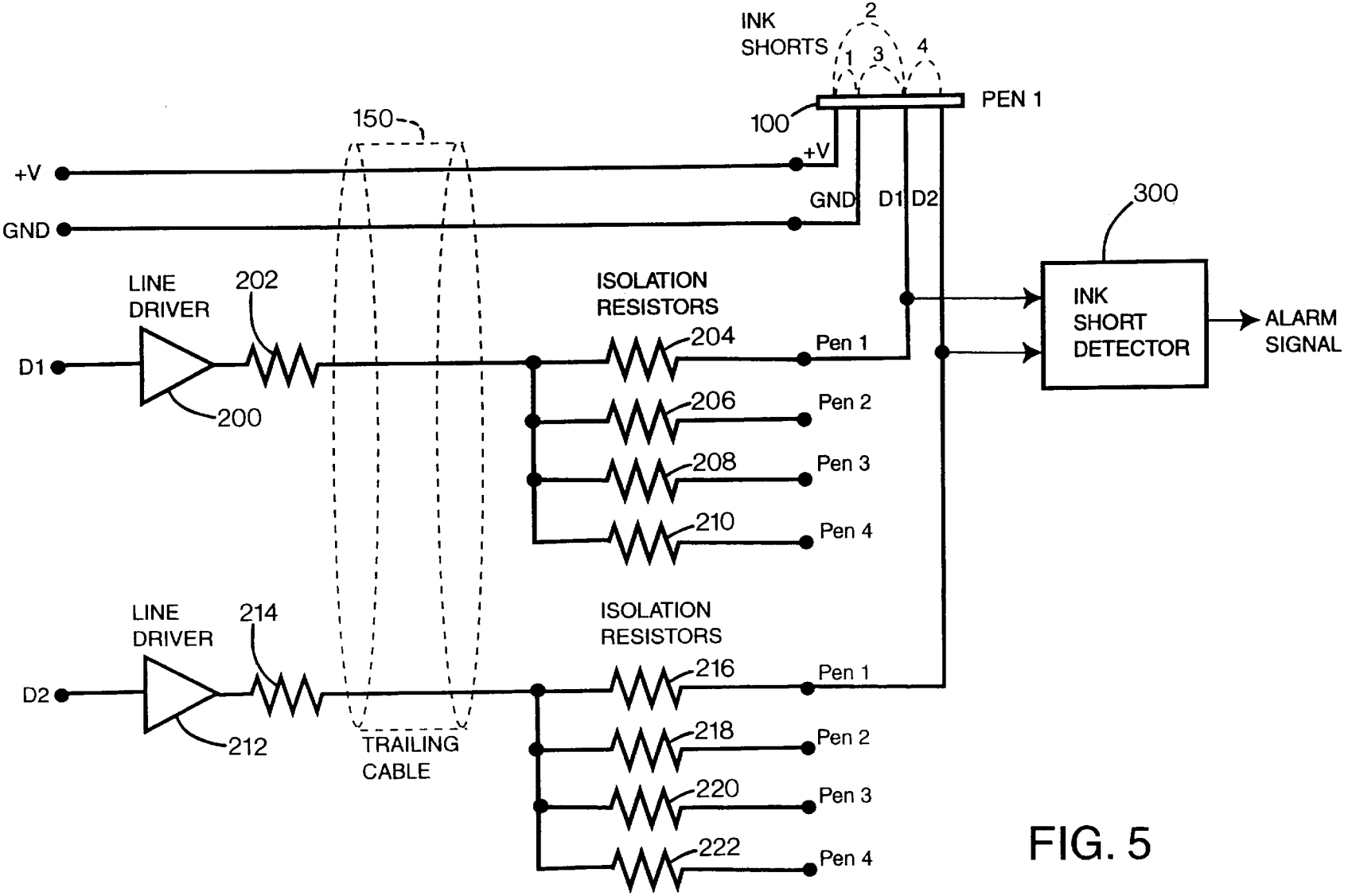
FIG. 5 is a simplified schematic diagram of a circuit for isolating ink shorts among the multiple printheads according to the present invention.

In FIG. 5, there is shown a simplified schematic diagram of a circuit for isolating ink shorts in the ink printer 20 according to the present invention. Only one pen is shown for purposes of illustration. The supply voltage +V and the ground GND are provided to at least one power supply contact and ground contact each on the electrical interface 100 for each of the pens 50–56. For each of the data lines, shown here to include only data lines D1 and D2 for purposes of example, additional circuitry is provided according to the present invention as discussed below for resistively isolating the data lines.

For data line D1, a line driver 200 having an output source impedance Rs represented by resistor 202 provides buffering and output current source and sink capability for data and clock signals. Isolation resistors 204–210, each with a common end connected to the resistor 202, are in turn connected to contacts on the flex strip 102 for each of the pens 50–56. In a like manner for data line D2, line driver 212 and resistor 214 provide buffering and output current source and sink capability to isolation resistors 216–222 which are connected to contacts on the flex strip 102 for each of the pens 50–56.

The following matrix shown as Table 1 illustrates the types of ink shorts that may be anticipated on the electrical interconnect 100 as a result of ink shorts occurring between electrical contacts, either as a result of ink leakage 121 or ink residue 120.

TABLE 1

| | +V | GND | Data |
|---|---|---|---|
| +V | X | 1 | 2 |
| GND | 1 | X | 3 |
| Data | 2 | 3 | 4 |

According to the matrix, an ink short between +V (power supply) and GND (ground) is a type 1 ink short which is the most serious because it can cause excessive current flow in the printer circuitry, leading to possible damage. The possibility of a type 1 ink short is minimized by interposing data contacts between power supply and ground contacts as discussed above for FIG. 4. An ink short between a data line and the supply voltage +V is a type 2 ink short. An ink short between a data line and ground is a type 3 ink short. An ink short between data lines is a type 4 ink short. The type 1–4 ink shorts are illustrated as the dashed lines on the surface of the flex strip 102 in FIG. 5.

An ink short can be detected in a number of ways. The quality of the printing can be visually monitored to detect a pen that has been impaired or disabled by the presence of an ink short. For example, if the black color is missing from printed pages, the problem can be quickly isolated to the pen 50 which has the black ink. An alarm signal may then be generated by the user, such as by pressing a button on a front panel of the printer 20 to provide for corrective action.

As an alternative to manually detecting ink shorts, active circuits may be employed to electrically monitor the functionality of the pens, the data lines, or both, in order to detect an ink short and isolate which of the pens 50–56 is having an ink short problem. Data lines that couple print and control data back from each of the pens 50–56 may be readily designed according to the present invention. The pens 50–56 may then contain circuits that affirmatively respond to print and control data. Failure of any of the pens 50–56 to respond to the print or control data could then be used to detect an ink short at the non-responsive pen and thereby generate an alarm signal to the printer controller 40.

When a data line is stuck at +V or at ground potential, or when two data lines are shorted together, as in type 2, 3, or 4 ink shorts, an ink short detector 300 with inputs connected to each data line at the flex strip 102 can detect the out of range voltages and provide an alarm signal. For example, a Schmit trigger having upper and lower voltage levels set to the desired limits may be placed on each data line and its output compared with the data at the input to the corresponding line driver in order to detect type 2, 3, or 4 ink shorts. A data line stuck at power supply or ground voltage potentials would be considered out of range and would generate an alarm signal. In addition to voltage detection, other means of detecting an ink short include monitoring current flows and loss of functionality of the pens 50–56. The alarm signal can then be provided to the printer controller 40 to generate an error message on a user interface such as an LCD display or indicator light or send an error message back through the printer interface to the host computer.

The circuit of FIG. 5, by resistively isolating the ink short to the affected data line, allows for further corrective action in the form of adaptive re-mapping. The color data for the pens can be adaptively re-mapped among the remaining good pens as explained in more detail in FIG. 7 below. The data can be adaptive re-mapped among the remaining good data lines as explained in more detail in FIG. 8 and 9 below. Alternatively, the adaptive re-mapping can remap data among good pens and good data lines in order to take maximum advantage of the available remaining resources to allowed continued printing in the presence of ink shorts.

Figure 6A:
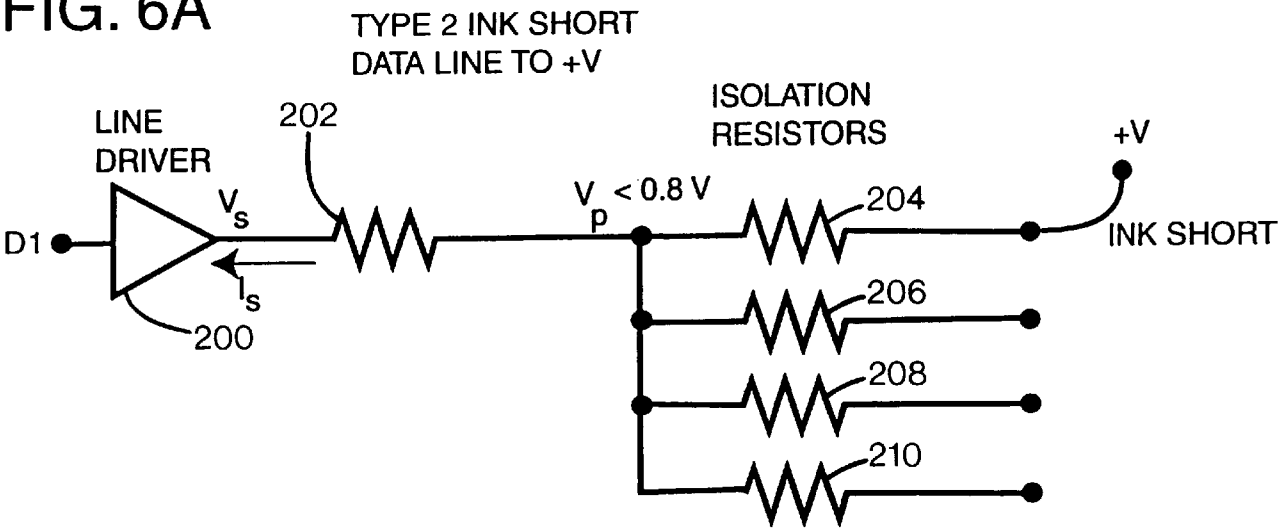
FIG. 6A and 6B are schematic diagrams illustrating equivalent circuits for several types of ink shorts for the circuit of FIG. 5.
Figure 6B:
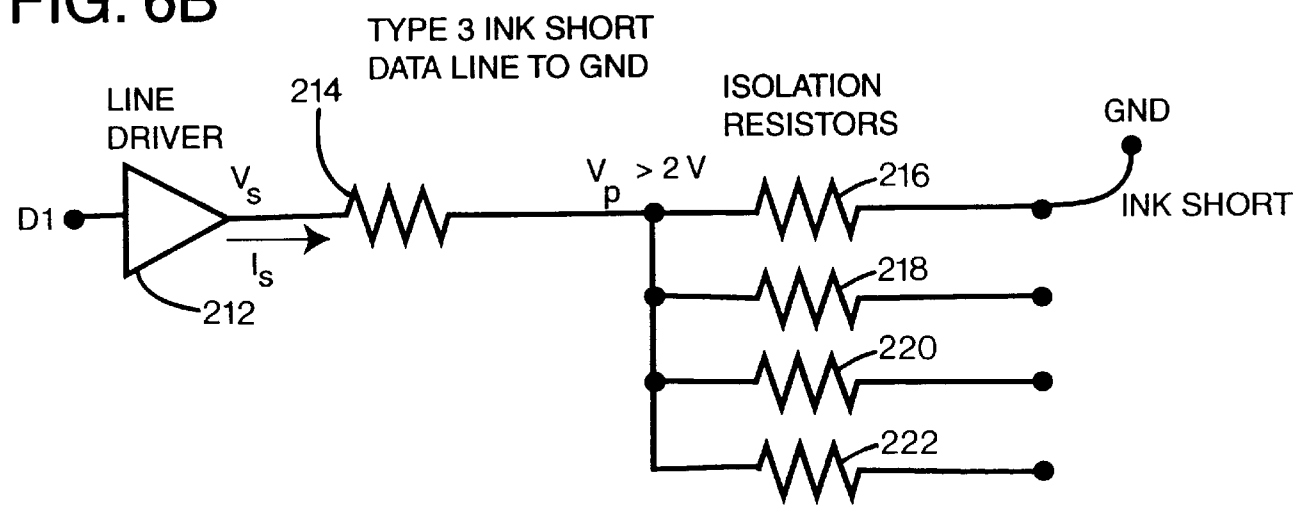

FIG. 6A and 6B are schematic diagrams illustrating the equivalent circuits for several types of ink shorts in which the data lines are resistively isolated. The type 2 ink short (FIG. 6A) and the type 3 ink short (FIG. 6B) are the worst case scenarios in achieving adequate resistive isolation between the data lines. Isolation between the affected data line and the remaining lines means that data signals still span predetermined minimum and maximum voltage levels to the remaining lines in order to be usable by unaffected pens which do not have ink shorts ("good pens").

The selection of resistor values for the isolation resistors 204–210 and for the isolation resistors 216–222 thus depend on a number of factors, including the output voltage current source and sink capability and output source resistance of the line drivers 200 and 212 as well as the maximum supply voltage +V that will be encountered. From these parameters, using straightforward circuit analysis techniques known in the art, a set of resistor values for the isolation resistors 204–210 and 216–222 may be selected.

As an example of the method of selecting resistor values for each of the isolation resistors 204–210 and 216–222 a line driver having a high voltage output of 2.4 V sourcing up to 16 milliamperes (mA), a low voltage output of 0.4 V sinking up to 16 mA, and an output source resistance of 51 ohms, is selected for each data line. A power supply voltage +V of 9.3 V is present in the printer 20. With the type 2 ink short according to FIG. 6A, the line driver 200 must be able to pull the voltage Vp below 0.8 V, the predetermined logical low threshold, in the face of an ink short of data line D1 to +V. A minimum resistance of 1,000 ohms for each of the isolation resistors may be selected to meet this criteria. Tradeoffs in signal bandwidth, current source and sink capability of the line driver, and noise immunity may be made by the skilled artisan in selecting appropriate values for the isolation resistors.

With the type 3 ink short according to FIG. 6B, the line driver 200 must be able to pull the voltage Vp above 2 V, the predetermined logical high threshold in the face of an ink short of data line D1 to ground GND. The 1,000 ohm resistance selected according to the isolation requirement for type 2 short circuits calculated above is sufficient for type 3 ink shorts.

Figure 7:
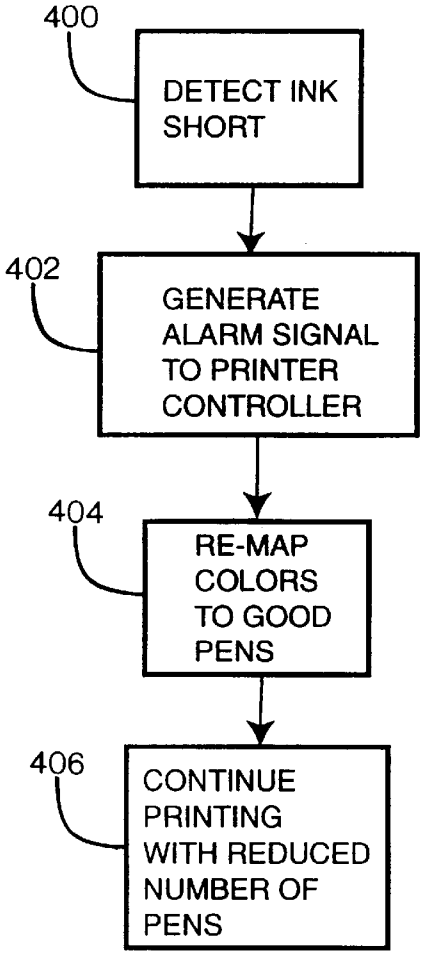
FIG. 7 is a flow diagram of a method of adaptively re-mapping data to good pens according to the present invention.

FIG. 7 is a flow diagram of a method of adaptively re-mapping data to good pens. In step 400 labeled DETECT INK SHORT, an ink short, which may be type 2, 3, or 4 as explained above, is detected using the ink short detector 300 (shown in FIG. 5).

In step 402 labeled GENERATE ALARM SIGNAL TO PRINTER CONTROLLER, the ink short detector 300 generates the alarm signal after detecting the ink short among one of the data lines. The alarm signal may include diagnostic information about the type of ink short, the pen number, and the data line affected, which is provided back to the printer controller 40.

In step 404 labeled RE-MAP COLORS TO GOOD PENS, the printer controller 40, responsive to the alarm signal, operates to re-map the data as arranged by pen colors, which include black, cyan, magenta, and yellow in the preferred embodiment, to exclude the affected pen. For example, if one of the color pens, pens 52–56, were to develop an ink short, an alarm signal indicating this condition to the printer controller 40 would cause either one or all of the pen colors to be re-mapped to a corresponding black level and supplied to the pen 50.

In step 406 labeled CONTINUE PRINTING WITH REDUCED NUMBER OF PENS, the printer 20 could continue printing with at least one good pen, for example as a monochrome printer, in the presence of an ink short. Alternatively, the data could be adaptively remapped in any number of different ways that would allow for continued printing with some combination of pen colors but with reduced functionality due to the ink short.

Particularly in the case of type 2 ink shorts as shown in FIG. 6A, which involves power supply to data line ink shorts, the power supply voltage to the affected pen may be removed according to the printer controller 40. Using this step reduces the requirements on the isolation resistors and line driver by removing +V from the pen affected by the ink short and further reduces the possibility of damage to printer circuitry if the ink short should continue to spread to a ground contact.

Figure 8:
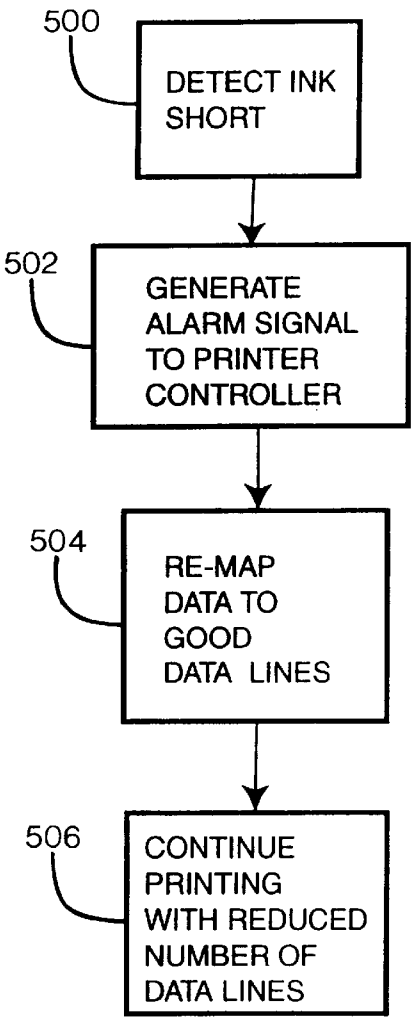
FIG. 8 is a flow diagram of a method of adaptively re-mapping data to good data lines according to the present invention.

FIG. 8 is a flow diagram of a method of adaptively remapping data to good data lines. In step 500 labeled DETECT INK SHORT, an ink short, which may be type 2, 3, or 4 as explained above, is detected using the ink short detector 300 (shown in FIG. 5).

In step 502 labeled GENERATE ALARM SIGNAL TO PRINTER CONTROLLER, the ink short detector 300 generates the alarm signal after detecting the ink short among one of the data lines. The alarm signal may include diagnostic information about the type of short and the data line affected which is provided back to the printer controller 40.

In step 504 labeled RE-MAP DATA TO GOOD DATA LINES, the printer controller 40, responsive to the alarm signal, operates to re-map the data for the pens to good data lines while bypassing the affected data line as explained below.

Figure 9:
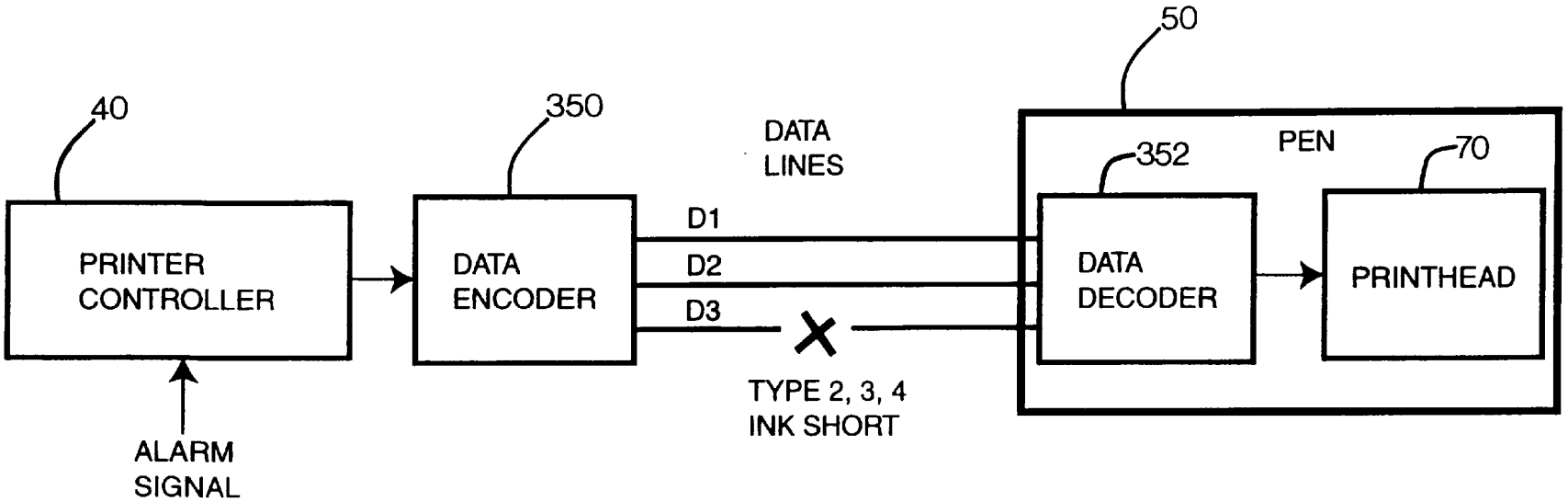
FIG. 9 is a block diagram of an adaptive encoder and decoder for re-mapping firing data to unaffected data lines according to the present invention.

FIG. 9 is a simplified schematic diagram of a circuit using a data encoder 350 coupled via the data lines D1–D3 to a data decoder 352 which operates to adaptively re-map data to data lines that have not been affected by ink shorts ("good data lines"). The data encoder 350 maps the data, which may be received as a stream of serial data words, to data words with a length corresponding to the number of good data lines. If data lines D1–D3 are all good, meaning none has been affected by ink shorts, the data encoder 350 would map the data into 3 bit data words. The data lines D1–D3 are preferably resistively isolated as described above to allow for good data lines in the presence of ink shorts that may disable some of the data lines. The resistive isolation circuitry is not shown for purposes of clarity.

The decoder 352 receives the data words and provides the data to the printhead 70. The decoder 352 may reside within the pen 50 or be deployed externally as needed. Because decoding is normally used to convert the firing data received from the data lines into individual firing sequences for nozzles, the data decoder 352 may form an implicit part of the printhead 70, which readily adapts to the number of good data lines. As shown, the data line D3 is affected by an ink short and rendered inoperable, resulting in the alarm signal being received by the printer controller 40. The printer controller 40 then instructs the data encoder 350 and data decoder 352 to map the data into smaller two bit data words and send them over the remaining good data lines D1 and D2.

Alternatively, the adaptive re-mapping process could simply involve switching serial data among available data lines. For example, the data may be sent to the pens as serial data, requiring only one data line at a time. In the event that the data line was affected by an ink short, other data lines could be selected until a good data line is found. Selecting among serial data lines would thereby simplify the requirements for the data encoder 350 and data decoder 352.

In step 506 labeled CONTINUE PRINTING WITH REDUCED NUMBER OF DATA LINES, the printer 20 could continue printing with full pen functionality in the presence of an ink short. In this case, two bit data words would be over the data lines D1 and D2 from the data encoder 350 to the data decoder 352. A reduced data rate of the firing data is the potential tradeoff if the data rate of the firing data becomes the limiting factor, resulting in slower overall print speed of the printer 20.

It will be obvious to those having ordinary skill in the art that many changes may be made in the details of the above-described preferred embodiments of the invention without departing from the spirit of the invention in its broader aspects. Adaptive remapping of the pens or data lines to work around the fault may be applied equally well to open data lines or other failures of the printhead or trailing cable that are not necessarily caused by ink shorts. Other means of electrically isolating the data lines, including the use of active circuits such as buffer amplifiers, may be substituted for the isolation resistors. Therefore, the scope of the present invention should be determined by the following claims.

What I claim as my invention is:

1. An apparatus for improving the reliability of an ink jet printer comprising:

a plurality of pens;

a power supply line coupled to each of said plurality of pens through at least one power supply contact;

a ground line coupled to each of said plurality of pens through at least one ground contact;

a printer controller;

a plurality of data lines coupled between said plurality of pens and said printer controller for carrying data from said printer controller to each of said pens;

a plurality of line drivers interposed between said printer controller and each of said data lines;

a set of isolation resistors interposed between each of said line drivers and each of said pens to resistively isolate each of said data lines from ink shorts developed at said pens; and an ink short detector coupled to each of said pens and to said printer controller wherein said ink short detector generates an alarm signal responsive to said ink shorts and said printer controller adaptively re-maps said data responsive to said alarm signal.

2. An apparatus for improving the reliability of an ink jet printer according to claim 1 wherein said printer controller adaptively re-maps said data to at least one good pen responsive to said alarm signal.

3. An apparatus for improving the reliability of an ink jet printer according to claim 2 wherein said ink jet printer continues to print with said good pen.

4. An apparatus for improving the reliability of an ink jet printer having a plurality of pens according to claim 1 wherein said printer controller adaptively re-maps said data to at least one good data line responsive to said alarm signal.

5. An apparatus for improving the reliability of an ink jet printer according to claim 4 wherein said ink jet printer continues to print using at least one of said good data lines.

6. A method for improving the reliability of an ink jet printer in the presence of ink shorts comprising:

providing at least one data line to a data contact, a ground line to a ground contact, and a power supply line to a power supply contact on an electrical interconnect;

interposing said data contact between said power supply contact and said ground contact on said electrical contact;

detecting an ink short between said data contact and one of said power supply contact and said ground contact;

generating an alarm signal responsive to said ink short; and adaptively re-mapping data to at least one good pen responsive to said alarm signal.

7. A method for improving the reliability of an ink jet printer according to claim 6 further comprising providing a plurality of pens and a plurality of data lines to each of said plurality of pens.

8. A method for improving the reliability of an ink jet printer according to claim 6 further comprising continuing printing by said ink jet printer with said good pen.

9. A method for improving the reliability of an ink jet printer according to claim 6 further comprising adaptively re-mapping data to at least one good data line responsive to said alarm signal.

10. A method for improving the reliability of an ink jet printer according to claim 9 further comprising continued printing by said ink jet printer with said good data line.

11. A method for improving the reliability of an ink jet printer having a plurality of pens in the presence of ink shorts comprising:

providing a plurality of data lines to data contacts on electrical interconnects to said pens;

placing at least one of said data contacts between a power supply contact and a ground contact on each of said electrical interconnects;

detecting an ink short between said data contact and one of said power supply contact and said ground contact;

generating an alarm signal responsive to said ink short; and adaptively re-mapping data to at least one good pen responsive to said alarm signal.

12. A method for improving the reliability of an ink jet printer according to claim 11 further comprising continuing printing by said ink jet printer with said good pen.

13. A method for improving the reliability of an ink jet printer according to claim 11 further comprising adaptively re-mapping data to at least one good data line responsive to said alarm signal.

14. A method for improving the reliability of an ink jet printer according to claim 13 further comprising continued printing by said ink jet printer with said good data line.

15. An apparatus for improving the reliability of an ink jet printer comprising:

a plurality of data lines coupled between at least one pen and said printer for carrying data from said printer to said pen;

a line driver interposed between said printer and each of said data lines;

a set of isolation resistors interposed between said line drivers and said pen wherein said data lines are resistively isolated from an ink short developed at said pen;

an ink short detector coupled to said pen wherein said ink short detector generates an alarm signal responsive to said ink short; and a plurality of pens each coupled to said plurality of data lines wherein said printer controller adaptively re-maps said data to at least one good pen responsive to said alarm signal.

16. An apparatus for improving the reliability of an ink jet printer according to claim 15 further comprising a printer controller coupled to said ink short detector to receive said alarm signal.

17. An apparatus for improving the reliability of an ink jet printer according to claim 15 wherein said printer controller adaptively re-maps said data to at least one good data line responsive to said alarm signal.

18. An apparatus for improving the reliability of an ink jet printer according to claim 17 wherein said ink jet printer continues printing with said good data line.

19. An apparatus for improving the reliability of an ink jet printer according to claim 15 wherein said ink jet printer continues printing with said good pen.

20. A method for improving the reliability of an ink jet printer in the presence of ink shorts comprising:

providing a plurality of data lines coupled between at least one pen and said printer for carrying data from said printer to said pen;

providing line drivers interposed between said printer and each of said data lines;

providing a set of isolation resistors interposed between said line drivers and said pen wherein said data lines are resistively isolated from an ink short developed at said pen;

detecting said ink short; and adaptively re-mapping said data responsive to said ink short.

21. A method for improving the reliability of an ink jet printer having a plurality of pens in the presence of ink shorts according to claim 20 further comprising adaptively re-mapping said data to at least one good data line responsive to said ink short.

22. A method for improving the reliability of an ink jet printer having a plurality of pens according to claim 21 further comprising continued printing by said ink jet printer with said good data line.

23. A method for improving the reliability of an ink jet printer having a plurality of pens in the presence of ink shorts according to claim 20 further comprising adaptively re-mapping said data to at least one good pen responsive to said ink short.

24. A method for improving the reliability of an ink jet printer having a plurality of pens in the presence of ink shorts according to claim 23 further comprising continuing printing by said ink jet printer with said good pen.

* * * * *